US007587852B1

(12) United States Patent
Harms

(10) Patent No.: US 7,587,852 B1
(45) Date of Patent: Sep. 15, 2009

(54) HANDGUN GRIP WITH A REMOVABLE AND REPLACEABLE GRIP PORTION

(75) Inventor: Raymond E. Harms, Chandler, AZ (US)

(73) Assignee: CCF RaceFrames LLC, Richmond, VA (US)

( * ) Notice: Subject to any disclaimer, the term of this patent is extended or adjusted under 35 U.S.C. 154(b) by 4 days.

(21) Appl. No.: 11/805,926

(22) Filed: May 25, 2007

(51) Int. Cl.
*F41C 17/00* (2006.01)

(52) U.S. Cl. ..... 42/71.02; 42/72; 42/74

(58) Field of Classification Search ..... 42/71.01, 42/71.02, 72, 73, 74
See application file for complete search history.

(56) References Cited

U.S. PATENT DOCUMENTS 4,936,036 A * 6/1990 Sniezak et al. ..... 42/71.02
6,112,446 A * 9/2000 Forster et al. ..... 42/71.02
2006/0150467 A1* 7/2006 Poulin et al. ..... 42/71.02

* cited by examiner

*Primary Examiner*—Stephen M Johnson
*Assistant Examiner*—Daniel J Troy
(74) *Attorney, Agent, or Firm*—Michael W. York

(57) ABSTRACT

A firearm handgun grip portion invention that includes the handgun grip portion of a handgun frame with a forward grip portion and a rear grip portion with the rear grip portion having connecting means for removably connecting a plurality of removable and replaceable grip portions to the rear grip portion of the handgun frame. The removable and replaceable grip portions are connected to and removed from the handgun grip portion of a handgun frame through a sliding motion with a projecting rib portion on the handgun grip portion sliding into and out of slots located in the removable and replaceable grip portions. Portions of the removable and replaceable grip portions are retained in a well to prevent them from spreading under pressure. The removable and replaceable grip portions have different configurations including grip portions with different sizes and different shapes, including the shape of another type of handgun such as the well known Model 1911 pistol.

4 Claims, 2 Drawing Sheets

Plurality of removable and replaceable rear grip portions with different:
1 configurations, 2 sizes, 3 shapes,
4 handgun grip shape.
Government Model 1911
Rear Grip Shape

HANDGUN GRIP WITH A REMOVABLE AND REPLACEABLE GRIP PORTION

BACKGROUND OF THE INVENTION

People naturally have different sizes add shaped hands. However, pistols and revolvers are normally manufactured and are sold with only one size, shape and style of a handgun grip portion. Consequently, there is a substantial probability that the handgun that an individual purchases will not have a grip that properly fits that person's hand. An improper size, shape and style of handgun grip portion can make the handgun uncomfortable to shoot, make it difficult to shoot accurately and can even make it unsafe to handle or to draw from a holster. In addition, individuals have their own preferences when it comes to the construction of a handgun grip. Some individuals will want a comparatively soft grip portion that has some give to it and yet other individuals will prefer a more rigid grip. In a similar manner, individuals have their own preferences when it comes to the type of external surface of a handgun grip. Some individuals will want a comparatively smooth grip portion and yet other individuals will prefer a grip that has checkering or the like on the grip surface that provides friction between the hand and the grip. Other advanced pistol shooters may have a preference for a particular style or configuration of the pistol grip portion, such as a preference for a Model 1911 type grip portion. These present problems are greatly compounded, in those instances when pistols or revolvers are purchased for use for multiple users such as for police departments or other law enforcement agencies where it is to expected that there will be multiple users for a pistol or revolver during its service life.

There have been various attempts to alleviate some of these problems. For instance, various manufacturers produce replacement grips for some of the pistols and revolvers. These generally require the removal of the original grip and the replacement of the original grip with the new grip which can be difficult and time consuming. Even then with such replacement grips, there is a substantial probability that a replacement handgun grip will not properly fit that person's hand size and shape. Consequently, a series of trial purchases most likely will be required which is at best inconvenient. There are no prior art systems that allow a user of a handgun to readily modify the grip portion to suit his or her hand size and shape. The same is also true to a lesser degree in connection with the style of the hand grip.

These problems have been overcome with this handgun grip with a removable and replaceable grip portion invention. This invention with the replaceable handgun grip portion makes it possible to provide a proper handgun grip portion for people that have different sizes and shaped hands even though pistols and revolvers are manufactured and are sold with only one size, shape and style of a handgun grip portion. With this invention, the user of the handgun can select the size, shape and style of handgun grip portion to make the handgun comfortable to shoot, make it shoot accurately and make it safe to handle or to draw from a holster. With this invention, an individual shooter can select the construction of a handgun grip for a comparatively soft grip portion that has some give or a more rigid grip. The shooter can also select the type of surface of a handgun grip portion. With this invention, it is even possible to allow the shooter to take a non-Model 1911 pistol and to convert it so that it has a Model 1911 style grip portion. This invention allows purchasers of pistols or revolvers for use by multiple users such as for police departments or other law enforcement agencies to have the capability of allowing the handgun grip portions to be configured to meet the needs and preferences of the individual law enforcement officer. This invention has a unique structure for connecting the grip portion to the handgun frame that readily allows the grip portion to be slipped off of the handgun frame and yet be securely fastened to the handgun frame so that it does not come lose under repeated heavy recoil of a large caliber handgun. In addition, this invention has a unique structure for connecting the grip portion to the handgun frame that prevents the grip portion from expanding outward due to heavy hand pressure on the grip portion from the shooter's hand.

SUMMARY OF THE INVENTION

This invention relates to handguns and more particularly to handgun grips and grip portions.

It is an object of the present invention to provide a handgun grip with a removable and replaceable grip portion that provides a handgun with increased versatility.

It is an object of the present invention to provide a handgun grip with a removable and replaceable grip portion that provides a handgun with the ability to have the grip portion modified to suit different requirements.

It is an object of the present invention to provide a handgun grip with a removable and replaceable grip portion that allows a handgun to be used with satisfaction by multiple users.

It is an object of the present invention to provide a handgun grip with a removable and replaceable grip portion that provides a handgun with increased performance capabilities.

It is an object of the present invention to provide a handgun grip with a removable and replaceable grip portion that can increase the accuracy of the handgun by allowing he shooter to select the replaceable grip portion that permits the shooter to readily line up the sights of the handgun with the target.

It is an object of the present invention to provide a handgun grip with a removable and replaceable grip portion that can reduce the felt recoil of the handgun.

It is an object of the present invention to provide a handgun grip with a removable and replaceable grip portion that can increase the safety of the firearm.

It is an object of the present invention to provide a handgun grip with a removable and replaceable grip portion that can reduce the possibility of the handgun grip slipping in the hand of the user.

It is an object of the present invention to provide a handgun grip with a removable and replaceable grip portion that allows the individual shooter to modify the handgun grip to suit his or her individual needs.

It is an object of the present invention to provide a handgun grip with a removable and replaceable grip portion that allows the individual shooter to modify the handgun grip to suit his or her individual preferences.

It is an object of the present invention to provide a handgun grip with a removable and replaceable grip portion that is rigidly secured to the grip portion of the handgun.

It is an object of the present invention to provide a handgun grip with a removable and replaceable grip portion that that is easy to change.

It is an object of the present invention to provide a handgun grip with a removable and replaceable grip portion that is easily changed by the user of the handgun.

It is an object of the present invention to provide a handgun grip with a removable and replaceable grip portion that is uniquely secured to the grip portion of the handgun.

It is an object of the present invention to provide a handgun grip with a removable and replaceable grip portion that is uniquely secured to the grip portion of the handgun through the use of a rib projecting from the grip of the frame of the handgun.

It is an object of the present invention to provide a handgun grip with a removable and replaceable grip portion that is uniquely secured to the grip portion of the handgun through the use of a well located in the grip portion of the frame of the handgun.

It is an object of the present invention to provide a handgun grip with a removable and replaceable grip portion that is uniquely secured to the grip portion of the handgun and is virtually impossible to become dislodged from the grip portion of the handgun.

It is an object of the present invention to provide a handgun grip with a removable and replaceable grip portion that is particularly suited for use by organizations that have multiple users for the handgun It is an object of the present invention to provide a handgun grip with a removable and replaceable grip portion that is particularly suited for use by law enforcement agencies.

It is an object of the present invention to provide a handgun grip with a removable and replaceable grip portion where the handgun grip is made from metal.

It is an object of the present invention to provide a handgun grip with a removable and replaceable grip portion where the grip and the frame are made from metal.

It is an object of the present invention to provide a handgun grip with a removable and replaceable grip portion where the grip and the frame are made in one piece from metal.

It is an object of the present invention to provide a handgun grip with a removable and replaceable grip portion where the grip portion and the frame are made in one piece from metal that results in a longer lifetime for the frame than a polymer frame.

It is an object of the present invention to provide a handgun grip with a removable and replaceable grip portion where the handgun grip and the frame are made in one piece from metal to increase the reliability of the handgun.

It is an object of the present invention to provide a handgun grip with a removable and replaceable grip portion where the handgun grip and the frame are made in one piece from metal to prevent undesirable flexing of the frame of the handgun.

It is an object of the present invention to provide a handgun grip with a removable and replaceable grip portion that is particularly suited for use with pistols.

These and other objects of the invention will be apparent from the following described handgun grip portion invention that includes the handgun grip portion of a metal handgun frame with a forward grip portion and a rear grip portion with the rear grip portion having unique connecting means for removably connecting a removable and replaceable rear grip portion to the rear grip portion of the handgun frame and a plurality of removable rear grip portions. The connecting means includes a projecting rib portion. A well, with the respective undercut sides and an upper end that is also undercut is located adjacent to the rib portion and prevents the outer edges of the grip portions from being pushed outward when a shooter is gripping the grip portions and the associated grip with great force. The removable and replaceable grip portions are connected to and removed from the handgun grip portion of a handgun frame through a sliding motion with the projecting rib portion on the handgun grip portion sliding into and out of slots located in the removable and replaceable grip portions. The removable and replaceable grip portions have different configurations and can include removable and replaceable grip portions with different sizes and different shapes, including the shape of another type of handgun such as the well known Model 1911 pistol. The different configurations of the removable and replaceable grip portions can also include removable and replaceable grip portions made from different materials and having different exterior surfaces.

BRIEF DESCRIPTION OF THE DRAWINGS

The invention will be hereinafter more completely described with reference to the accompanying drawings in which.

DETAILED DESCRIPTION OF THE PREFERRED EMBODIMENTS

Figures 1, 2, 3, 4, 5:
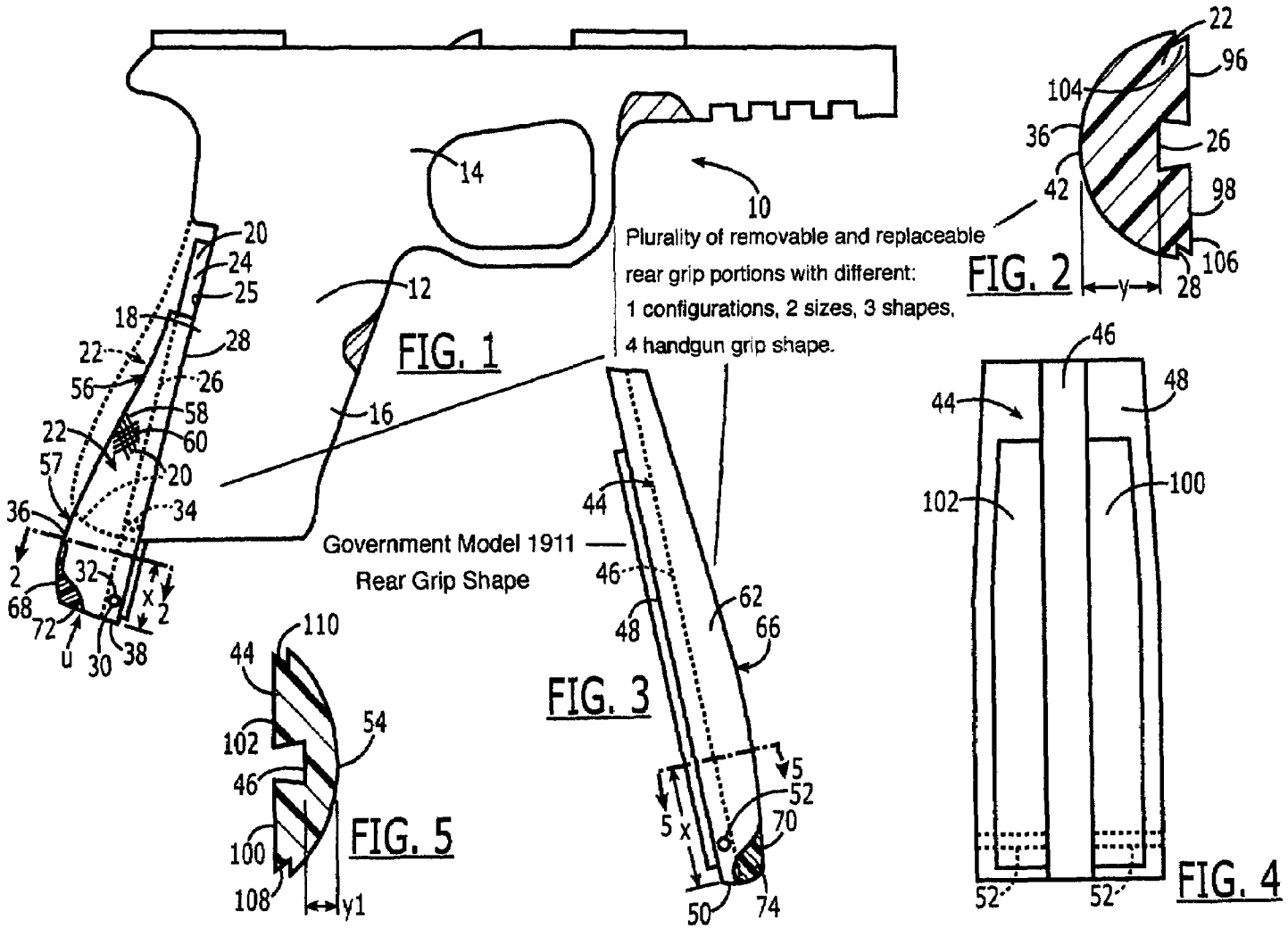
FIG. 1 is a side elevational view of the removable grip portion invention incorporated into an entire pistol frame.
FIG. 2 is an enlarged sectional view of the removable grip portion set forth in FIG. 1 taken in the direction of the line 2-2 thereof.
FIG. 3 is a side elevational view of an additional removable and replaceable grip portion for the handgun grip portion illustrated in FIGS. 1 and 2.
FIG. 4 is an elevational view of the removable grip portion set forth in FIG. 3 taken from the left of the grip portion set forth in FIG. 3.
FIG. 5 is an enlarged sectional view of the removable grip portion set forth in FIG. 3 taken in the direction of the line 5-5 thereof.

Referring first to FIG. 1 the handgun grip with a replaceable grip portion invention is illustrated and is designated general by the number 10. As illustrated in FIG. 1 the handgun grip with a replaceable grip portion invention 10 comprises a downward extending grip 12 that is part of a pistol frame 14 and this grip 12 has a forward grip portion 16 and a rearward grip portion 18. The rearward grip portion 18 of the pistol grip 12 has connecting means 20 for removably connecting a replaceable grip portion 22 to the rearward grip portion 18. This connecting means includes a downward extending projecting rib portion 24 that extends outward from the adjacent surface 25 of the rearward grip portion 18. This downward extending projecting rib portion 24 is sized, shaped and located to fit into a corresponding groove 26 located in the inner surface 28 of the removable and replaceable grip portion 22. As illustrated, the removable and replaceable grip portion 22 is connected to the rearward grip portion 18 of the downward extending grip 12 by manually pushing upward as illustrated by the arrow and the letter U with the rib portion 24 located in the groove 26 in the inner surface 28 of the removable and replaceable grip portion 22. Once the grip portion 22 is pushed completely upward so that the grip portion is in its fully seated position as indicated by the dashed lines, the grip portion 22 is secured in place to the rearward grip portion 18 of the downward extending grip 12 by a pin 30 that is pushed through a hole 32 in the lower portion of the grip portion 22 and into a hole 34 in the lower portion of the rib portion 24 of the rearward grip portion 18.

It will be noted that the removable and replaceable grip portion 22 has an enlarged portion 36 at its lower end portion which is preferred by many experienced shooters. This enlarged portion 36 is also apparent in the sectional view in FIG. 2. FIG. 2 shows the sectional view of the grip portion 22 in FIG. 1 taken in the direction of the line 2-2. It will be noted that this section is taken at a distance X from the bottom 38 of the removable and replaceable grip portion 22. As indicated in FIG. 2, there is a comparatively large distance Y from the bottom of the groove 26 to the adjacent outer surface 42 of the removable and replaceable grip portion 22 at the location where the section 2-2 is taken.

FIGS. 3 and 4 illustrate an alternative removable and replaceable grip portion for the previously described removable and replaceable grip portion 22 that is designated generally by the number 44. This removable and replaceable grip portion 44 has a groove 46 located in its inner surface 48 that is substantially identical to the groove 26 located in the inner surface 28 of the removable and replaceable grip portion 22. Consequently, this removable and replaceable grip portion 44 accepts and fits on the projecting rib portion 24 on the rearward grip portion 18. However, the removable and replaceable grip portion 44 has a different size than the removable and replaceable grip portion 22. In this connection, FIG. 5 is a sectional view of the removable and replaceable grip portion 44 taken the same distance X up from the bottom 50 of the removable and replaceable grip portion 44 as the removable and replaceable grip portion 22. It is readily apparent that this cross sectional view is substantially different from the cross sectional view for the removable and replaceable grip portion 22 set forth in FIG. 2. Specifically, the distance Y1 from the bottom of the groove 46 and the adjacent outer surface 54 of the removable and replaceable grip portion 44 is substantially less than the corresponding distance Y for the cross section of the removable and replaceable grip portion 22. The removable and replaceable grip portion 44 also has a hole 52 in its lower portion that is identical to the previously described hole 32 in the removable and replaceable grip portion 22.

By comparing the removable and replaceable grip portion 44 set forth in FIGS. 3 and 4 with the removable and replaceable grip portion 22 set forth in FIGS. 1 and 2, it can be readily seen that there are other differences between the structure of the removable and replaceable grip portion 44 and the removable and replaceable grip portion 22 other than just the size of the respective grip portions 44 and 22 at a particular location. In this connection, not only is the removable and replaceable grip portion 22 larger than the removable and replaceable grip portion 44, but it also has a different shape since the removable and replaceable grip portion 22 has a pronounced inward curve designated by the arrow and number 56 and an outward bulge designated by the arrow and the number 57 in FIG. 1 whereas as illustrated in FIG. 3, the removable and replaceable grip portion 44 has no such inward curve 56 and the bulge 57. Consequently, the removable and replaceable grip portion 22 has a different shape than the removable and replaceable grip portion 44. It will also be noted that the exterior 58 of the removable and replaceable grip portion 22 has checkering 60 whereas the exterior 62 of the removable and replaceable grip portion 44 has a substantially smooth surface.

As best illustrated in FIG. 3, the removable and replaceable grip portion 44 has an overall rear grip portion exterior shape that is designated by the number 66 that is substantially identical to the rear grip portion shape of the classic Government Model 1911 pistol. This Model 1911 rear grip portion shape is preferred by many serious pistol shooters and with this handgun grip with a replaceable grip portion invention 10 with the removable and replaceable grip portion 44 with this Model 1911 overall rear grip portion exterior shape 66, it is possible to provide the shooter with this desired grip shape. It will of course be understood that if there is another handgun overall rear grip portion exterior shape that becomes desirable to handgun shooters this shape can easily be added to or made part of the removable and replaceable grip portion 22 or the removable and replaceable grip portion 44.

As illustrated by the broken away portions 68 and 70 in the removable and replaceable grip portion 22 and the removable and replaceable grip portion 44 in the respective FIGS. 1 and 3, the removable and replaceable grip portion 22 or the removable and replaceable grip portion 44 are made from different synthetic materials that are represented by the numbers 72 and 74. The synthetic material 74 is softer and has more give to it than the synthetic material 72 and this provides the shooter with a choice of grip portion hardness. Some individuals will want a comparatively soft grip portion that has some give to it and yet other individuals will prefer a more rigid grip portion.

Figure 7:
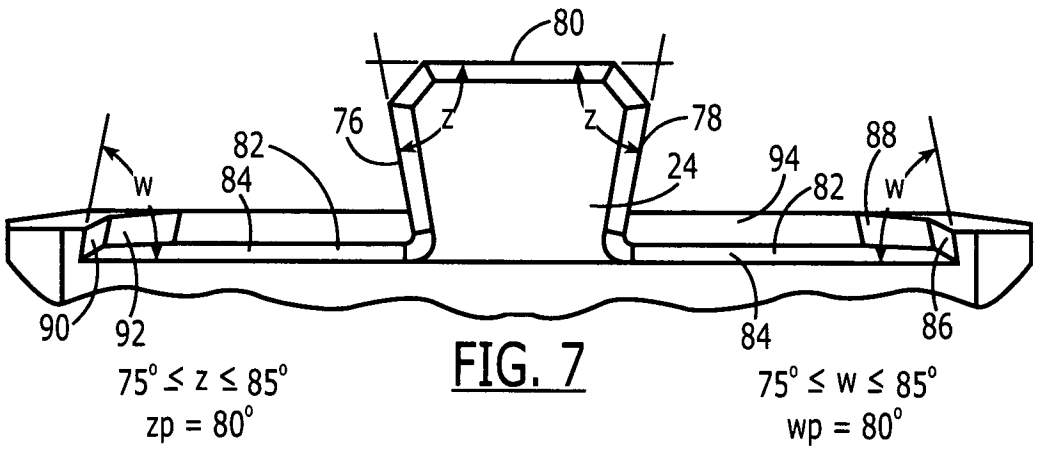
FIG. 7 is an enlarged view of the connecting structure illustrated in FIG. 6 taken in the direction of the line 7-7 thereof.
Figure 6:
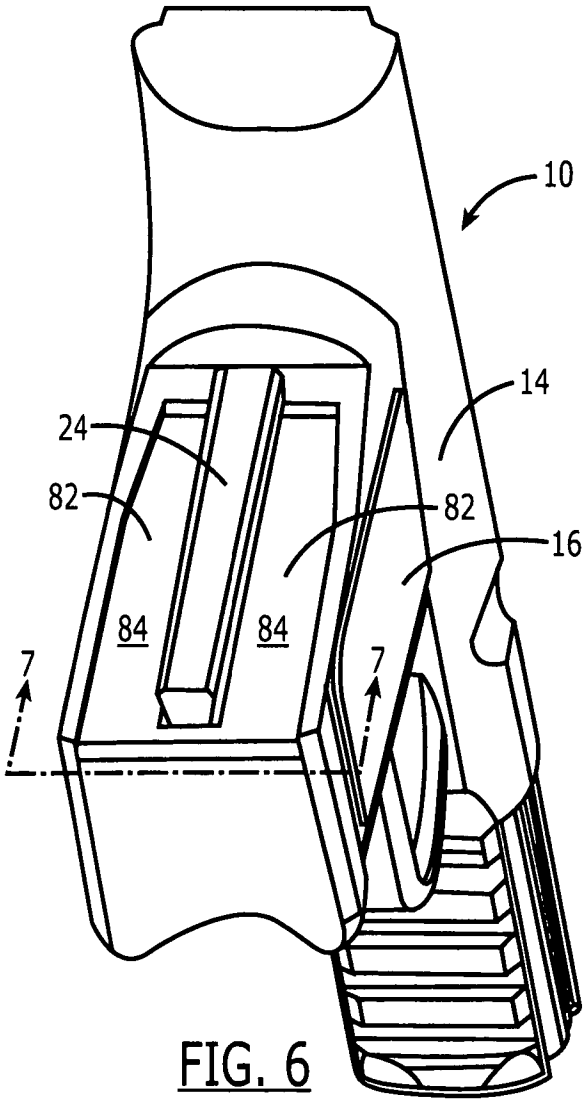
FIG. 6 is an enlarged rear perspective view of a pistol incorporating the connecting structure of the present invention.

FIGS. 6 and 7 illustrate important novel features of the connecting means 20 including the rib portion 24 and adjacent structure. As illustrated, the rib portion 24 has two oppositely located inward sloping walls 76 and 78 that slope inwardly at an angle Z with the flat outer surface 80 of the rib portion 24 that is between about 75 degrees to about 85 degrees or in the preferred embodiment ZP about 80 degrees from the flat outer surface 80 of the rib portion 24. These inwardly sloping walls 76 and 78 are important since they hold or secure the grooves or channels 26 and 46 of the respective removable and replaceable grip portions 22 and 44 to the rib portion 24 and hence secure the grip portions 22 and 44 to the rib portion 24 of the rearward grip portion 18 and comprise holding means for holding the grooves in the plurality of removable and replaceable rear grip portions to the downward extending projecting rib portion.

FIGS. 6 and 7 also illustrate another important novel feature that is the shallow depressed well 82 that is located on each side of and immediately adjacent to the rib portion 24. This well 82 is cut or formed in the surface of the rearward grip portion 18. This well 82 has a substantially flat bottom surface 84. This well 82 has respective undercut sides 86 and 88 that are located oppositely from respective undercut sides 90 and 92 and an upper end 94 that is also undercut. The angle of these undercuts are substantially identical and is at an angle W that is between about 75 degrees to about 85 degrees with the flat bottom surface 84 of the well 82 or in the preferred embodiment WP about 80 degrees from the flat bottom surface 84 of the well 82.

As illustrated in FIGS. 2 through 5, the grip portions 22 and 44 have substantially identical respective projecting inner portions 96 and 98 and 100 and 102 that are sized, shaped and located to slide into the well 82. In order to assist this sliding, it will be noted in FIGS. 6 and 7 that the well 82 tapers outwardly toward the bottom of the rib portion 24. As illustrated in FIGS. 2 and 5, it will be noted that the outer edges of the respective identical projecting inner portions 96 and 98 and 100 and 102 of the grip portions 22 and 44 have respective sloping outer edge portions 104 and 106 and 108 and 110 that slope at substantially the same angle as the corresponding angle W of the respective undercut sides 86 and 88 and 90 and 92 and an upper end 94 so that they slip into these undercuts. This configuration of the well 82, with the respective undercut sides 86 and 88 that are located oppositely from respective undercut sides 90 and 92 and an upper end 94 that is also undercut and the associated sloping outer edge portions 104 and 106 and 108 and 110 of the respective identical projecting inner portions 96 and 98 and 100 and 102 are important since they prevent the outer edges of the grip portions 22 and 44 from being pushed outward when a shooter is gripping the grip portions 22 and 44 and the associated grip 12 with great force. In view of the description of the well 82 and the associated sloping outer edge portions 104 and 106 and 108 and 110 of the respective identical projecting inner portions 96 and 98 and 100 and 102, they comprise means for resisting lateral movement of portions of the removable and replaceable rear grip portion 22 or 44 when the removable and replaceable rear grip portion 22 or 44 is in use due to pressure from the hand of the user.

The handgun grip with a replaceable grip portion invention 10 is used in the following manner. Normally, the handgun grip with a replaceable grip portion invention 10 will be supplied with a series of removable and replaceable grip portions such as the previously described removable and replaceable grip portion 22 and the removable and replaceable grip portion 44 so that the prospective shooter has a wide choice of the type of removable and replaceable grip portion that can be selected and used. Depending upon the circumstances, the handgun grip with a replaceable grip portion invention 10 may be supplied to the prospective shooter as part of a frame 14 of a completely assembled handgun or the handgun grip with a replaceable grip portion invention 10 may be supplied as part of only the frame 14. In both of these cases the frame 14 may or may not have the associated removable and replaceable grip portion such as the removable and replaceable grip portion 22 or the removable and replaceable grip portion 44 connected to the grip 12 of the frame 14.

For the purposes of this description, it will be assumed that the removable and replaceable grip portion 22 or 44 is not connected to the grip 12 of the frame 14. In this situation, in order to use the frame 14, it will be necessary for the prospective shooter to attach a removable and replaceable grip portion such as a removable and replaceable grip portion 22 or 44 to the grip 12 of the frame 14. This is easily accomplished by the shooter holding the frame 14 in one hand with the rib portion 24 extending away from the hand and then grasping the removable and replaceable grip portion such as the removable and replaceable grip portion 22 or 44 with the other hand so that the groove 26 or 46 is facing toward the rib portion 24. Then, by making appropriate hand movements the shooter slides the rib portion 24 into the groove 26 or 46 in the removable and replaceable grip portion 22 or 44. Then, the shooter slides the pin 30 into the hole 32 in the lower portion of the grip portion 22 or the equivalent hole 52 in the lower portion of the grip portion 44 and into the hole 34 in the lower portion of the rib portion 24 of the rearward grip portion 18. The handgun grip with a replaceable grip portion 10 is then ready for use and is connected to the rest of the handgun in a conventional manner. This process is basically reversed when it is desired to replace the removable and replaceable grip portion with a different removable and replaceable grip portion.

In the preferred embodiment, the frame 14 of the handgun grip with a replaceable grip portion invention 10 is made from a suitable metal such as carbon or stainless steel, aluminum or titanium by die casting or by investment casting in a manner known to those skilled in the art. As indicated previously, the well 82 is cut or formed in the surface of the rearward grip portion 18 and this is accomplished in a conventional manner. Also, in the preferred embodiment, the removable and replaceable grip portions such as the removable and replaceable grip portion 22 and the removable and replaceable grip portion 44 of the handgun grip with a replaceable grip portion invention 10 are made from a suitable synthetic material such as polymers, urethane or a metal that is manufactured by injection molding or by machining from solid stock or by die casting in a manner known to those skilled in the art.

It will be noted that the handgun grip with a replaceable grip portion invention 10 has been described with reference to forward and rearward and upward and lower or downward and like terms and that such terms are meant to describe the handgun grip with a replaceable grip portion invention 10 as the invention and an associated handgun (not shown) would normally be oriented in position for being fired with the muzzle of the barrel pointing forward and with the grip portion being at the other end or rearward and pointing in a downward direction.

Although the invention has been described in considerable detail with reference to certain preferred embodiments, it will be understood that variations or modifications may be made within the spirit and scope of the invention as defined in the appended claims.

What is claimed is:

1. A handgun grip with a replaceable grip portion comprising a handgun frame with a handgun grip portion having a forward grip portion and a rearward grip portion with the rearward grip portion having connecting means for removably connecting a removable and replaceable rear grip portion to the rear grip portion of the handgun frame comprising a downward extending projecting ridge portion extending outward from the rearward grip portion of the handgun frame and a plurality of removable and replaceable rear grip portions each having a groove located therein and wherein each groove is sized, shaped and located to slideably receive the downward extending projecting ridge portion extending outward from the rearward grip portion of the handgun frame, securing means associated with the downward extending projecting ridge portion for securing the plurality of removable and replaceable rear grip portions to the downward extending projecting ridge portion after a removable and replaceable rear grip portion has been located on the downward extending projecting ridge portion and wherein the plurality of removable and placeable rear grip portions have different configurations and means for resisting lateral movement of the removable and replaceable rear grip portion when the removable and replaceable grip portion is in use comprising a well located in the rear grip portion of the handgun frame and therein the well is located on each side of the projecting ridge portion and the well tapers outwardly toward the bottom of the projecting ridge portion and an associated projecting portion located on the removable and replaceable rear grip portions for resisting lateral movement of portions of the removable and replaceable rear grip portion when the removable and replaceable rear grip portion is in use.

2. The handgun grip with a replaceable grip portion of claim 1 wherein the well has sloping sides sloping toward the interior of the rear grip portion of the handgun frame and the associated projecting portion located on the removable and replaceable rear grip portions have edges sized, shaped and located to slide under the sloping sides of the well.

3. The handgun grip with a replaceable grip portion of claim 1 wherein the well has a substantially flat bottom surface and the sloping sides of the well form an angle W as set forth below:

$75° \leqq W \leqq 85°$.

4. The handgun grip with a replaceable grip portion of claim 3 wherein the sloping sides of the well form an angle W that is about 80 degrees with the substantially flat bottom surface of the well.

* * * * *